US006065218A

United States Patent [19]

Edwards

[11] Patent Number: 6,065,218

[45] Date of Patent: May 23, 2000

[54] METHOD AND APPARATUS FOR LOGGING NON-CIRCULAR BOREHOLES

[75] Inventor: John Edwards, Loyand Crescent, Singapore

[73] Assignee: Schlumberger Technology Corporation, Houston, Tex.

[21] Appl. No.: 08/532,207

[22] Filed: Sep. 22, 1995

[30] Foreign Application Priority Data

Sep. 23, 1994 [EP] European Pat. Off. ..... 94402116

[51] Int. Cl.[7] ..... E21B 47/08; G01B 5/12

[52] U.S. Cl. ..... 33/544; 33/302; 33/303; 33/544.2

[58] Field of Search ..... 33/544, 302, 542, 33/543, 544.1, 544.2, 544.3, 303, 304

[56] References Cited

U.S. PATENT DOCUMENTS

| | | | |
|---|---|---|---|
| 2,846,190 | 8/1958 | Saurenman . | |
| 2,864,173 | 12/1958 | Castel | 33/544.2 |
| 3,648,515 | 3/1972 | Youmans . | |
| 3,772,794 | 11/1973 | Hopler, Jr. | 33/544.2 |
| 4,506,219 | 3/1985 | Lee . | |
| 4,595,055 | 6/1986 | Vannier | 33/544.3 |
| 5,101,104 | 3/1992 | Schroeder . | |
| 5,565,624 | 10/1996 | Deboaisne et al. | 33/544 |
| 5,629,480 | 5/1997 | Herget | 33/544 |

FOREIGN PATENT DOCUMENTS

| | | | |
|---|---|---|---|
| 0 546 892 A1 | 12/1992 | European Pat. Off. . | |
| 3611374C1 | 8/1987 | Germany . | |
| 2156984 | 10/1985 | United Kingdom | 33/544 |

*Primary Examiner*—Christopher W. Fulton
*Attorney, Agent, or Firm*—John J. Ryberg; Brigitte L. Jeffery

[57] ABSTRACT

The invention relates to a logging method and apparatus adapted for use in non-circular boreholes which, in one embodiment, comprises the use of a first and a second sonde, each sonde having: a pad adapted for contact with the borehole wall, at least a sensor on each pad, and an extendable arm for keeping the pad against the wall of the borehole. The first and second sonde produce measurements related to the same property of the formations, and the first and the second sonde are connected so as to keep the pads aligned with a 90° azimuthal spacing therebetween.

5 Claims, 1 Drawing Sheet

METHOD AND APPARATUS FOR LOGGING NON-CIRCULAR BOREHOLES

BACKGROUND OF THE INVENTION

1. Field of the Invention

The invention relates to the logging of subsurface formations traversed by a borehole, by means of logging sondes displaced along the borehole and equipped with a sensor-carrying pad urged into contact with the borehole wall. More specifically, the invention relates to a logging technique adapted for use in stressed boreholes.

2. Description of the Prior Art

Tectonic stress is known to cause borehole breakout along the direction of least horizontal stress. In that case, the borehole has a larger dimension ("long axis") in the direction of breakout than in the perpendicular direction ("short axis"). A borehole with breakout is exemplified on FIG. 1, which is an ultrasonic image of a 20 centimeters high section of the borehole, shown as if seen from above. This example shows that the shape of the borehole cross-section may be quite irregular, and far indeed from a pure geometrical figure such as an ellipsis or an oval. For that reason, such boreholes shall simply be referred to hereinafter as "non-circular".

When logging sondes having a wall contact pad, such as those producing density and microresistivity logs, are run in a non-circular borehole, the pad and the sonde with its backup spring or spring-loaded arm which urges the pad into contact with the borehole tend to align with the "long axis" (breakout axis). Unfortunately, as illustrated on FIG. 1, the "long axis" regions of the borehole wall are rugose as a result of breakout, which results in a poor contact between the pad and the borehole wall, thus severely affecting the quality of the logs.

A technique known as "short-axis logging"has been implemented as an attempt to obtain good quality logs in non-circular boreholes. The purpose is to ensure contact of the pad with the borehole wall in its "short axis" regions, which, as shown on FIG. 1, are smoother and more susceptible to provide good contact with the pad than the "long axis regions". In order to align the pad with the "short axis", the sonde is equipped with extra springs, arranged so that the potential energy of the total spring system is minimized when the sonde is aligned along the "short axis". Such arrangement has led to some improvement over short sections of the borehole, but does not reliably align the sonde with the "short axis": in nearly circular boreholes, proper alignment is not ensured, and in sections with breakout, it was found that the sonde remained aligned with the long axis despite repeated attempts to correct its orientation.

SUMMARY OF THE INVENTION

The purpose of the invention is to improve over the existing technique and to enable logs of acceptable quality to be obtained in non-circular boreholes.

This objective is attained with the logging method and apparatus of the present invention where, in one embodiment, first and second sondes produce formation property measurements at 90° azimuthal spacing from each other.

BRIEF DESCRIPTION OF THE DRAWINGS

The invention will become apparent upon reading the following description, made with reference to the attached drawings.

In the drawings.

DESCRIPTION OF PREFERRED EMBODIMENTS

Figure 1:
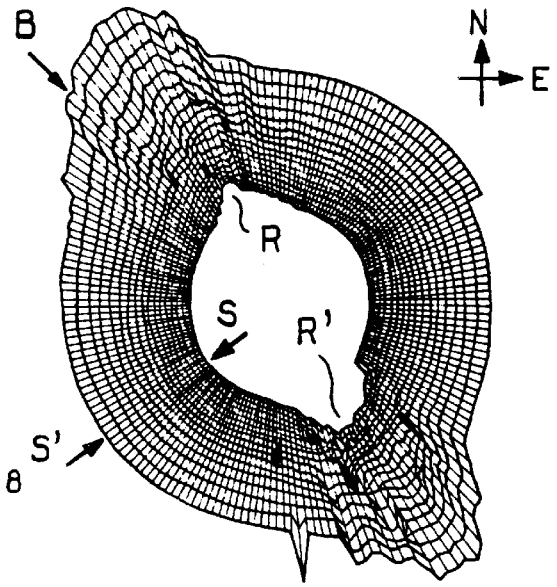
FIG. 1 shows an example of a borehole with breakout.

FIG. 1 illustrates the effect of tectonic stress on the geometry of a borehole. The breakout axis is indicated at B. It is apparent on FIG. 1 that while the cross-section of the borehole can be roughly depicted as a "flattened circle", and a "long axis" (substantially aligned with the breakout axis) and a "short axis" can be identified, the cross-section of the borehole is asymmetrical and irregular, and the rugosity of the borehole wall shows wide variations. The borehole wall is extremely rugose in the breakout regions R, R', while it is smooth in the "short axis" region along generatrix S—S'.

Figure 2:
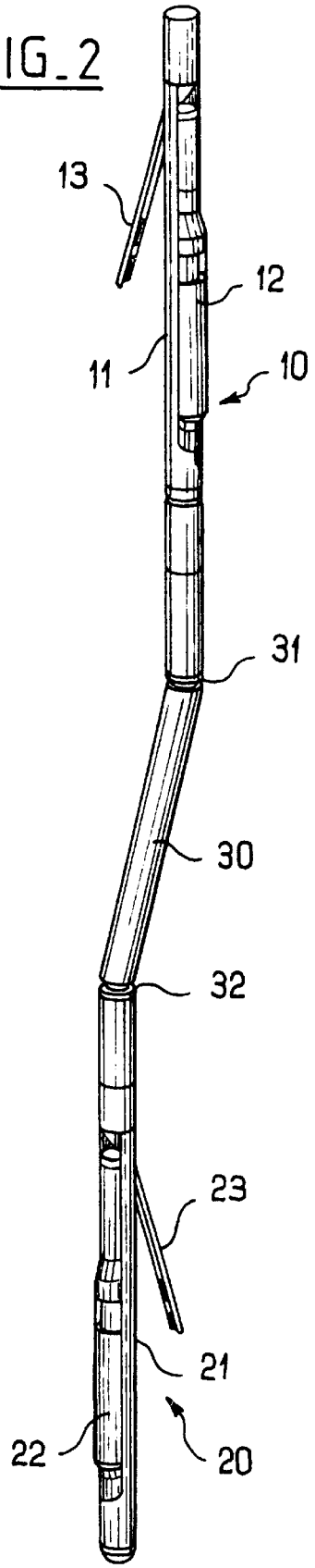
FIG. 2 shows an embodiment of a logging tool string according to the invention.

FIG. 2 shows an embodiment of a logging tool string according to the invention. In the described embodiment, the string includes gamma ray density tools, namely Schlumberget's Litho-Density Tool (LDT). But it is to be pointed out that the invention is not limited to a particular type of logging tool and applies to all kinds of logging tools which include a sensor-carrying pad adapted for engagement with the wall of the borehole. Another example is Schlumberger's MSFL, a microresistivity logging tool.

It will be understood that in use, the logging tool string of FIG. 1 is suspended from a logging cable connected to a surface equipment, with a telemetry unit provided between the tool string and the cable. Such equipments are conventional and need not be described in detail.

Figure 3:
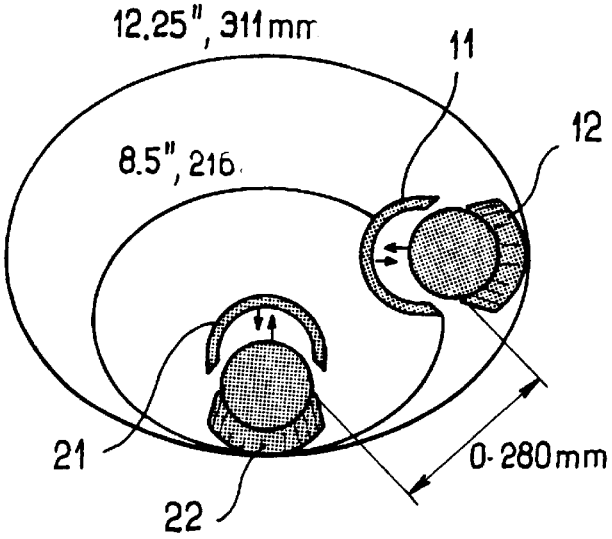
FIG. 3 is a schematic cross-section showing the orientation of the pads in the tool string.

In addition, the tools shown in FIG. 2 may be used in conjunction with logging tools of other types such as a resistivity tools (induction or Laterolog), a neutron logging tool, etc. The string comprises a pair of logging tools, an upper tool 10 and a lower tool 20, which are preferably identical. Each tool includes an elongate body resp. 11, 21. A pad resp. 12, 22 carrying a gamma ray source and gamma ray detectors is mounted on one side of the body. The pad is movable between a retracted position and a deployed position. A spring-loaded arm resp. 13, 23 is provided on the side of the body in diametrical opposition (with respect to the tool axis) to the pad. The arm resp. 13, 23 is held retracted during the descent of the tool string and once the string has reached the bottom of the section to be logged, the arm is released and urged by its spring into engagement with the borehole wall. The pad resp. 12, 22 is linked to the arm resp. 12, 23 so that they form a system which urges both the arm and the pad against opposite regions of the borehole wall. This arrangement is conventional in Schlumberger's Litho-Density Tool and will not be described in detail here. The tools 10, 20 are connected by a spacer sub 30 which prevents relative rotation between the tools and constrains the tools to remain 90° apart in azimuth. In other words, the respective symmetry planes of pads 12, 22 are always perpendicular, as shown in FIG. 3. This may be achieved by providing respective key and slot arrangements (not shown) at the connections between the spacer sub 30 and the tools 10, 20, thus securing angularly the tools to the spacer sub, with a 90° spacing between the azimuthal positions of the key slots.

In addition, provision is made so that the tools 10, 20 may have their axes offset, in order for the pads to be normal to, and firmly pressed against the borehole wall in various borehole diameters and geometries, as shown in FIG. 3. For that purpose, knuckle joints 31, 32 are provided for connecting the spacer sub and the respective tools 10, 20. Knuckle joints, as shown in FIG. 2, enable spacer sub 30 to tilt in any direction with respect to the respective tool, without allowing relative rotation. Typically, the maximum tilt angle provided by knuckle joints is 4°. It is to be noted that the fitness to various borehole dimensions/geometries is enhanced by the ability to move the pads with respect to the tool body, as illustrated in FIG. 3.

As usual in logging equipment, electrical conductors are routed through the spacer sub and knuckle joints to convey electrical command signals and power to, and measurement data from, tool 20.

The performance of a logging operation with a tool string such as shown in FIG. 2 requires the simultaneous acquisition of the measurement data produced by the tools, so as to produce two logs of the same property, for instance, formation density, in the same section of the borehole.

When a tool string as shown in FIG. 2 is displaced in a non circular borehole such as a borehole with breakout, one of the tools settles in a position aligned with the "long axis" and consequently, the other tool will align with the "short axis". As the borehole wall is fairly smooth in the short axis region of the borehole wall, as apparent on FIG. 1, the tool aligned with the "short axis" will produce measurements of acceptable quality while the other tool having its pad in contact with a rugose region is likely to yield poor data. Thus, whatever the borehole geometry, a log of acceptable quality may be obtained.

I claim:

1. A logging method adapted for use in non-circular boreholes, comprising the steps of:

producing a first log related to a property of the formations traversed by the borehole, by means of a first sonde having at least a sensor carried by a pad kept in contact with the borehole wall, simultaneously producing a second log related to the same property, by means of a second sonde having at least a sensor carried by a pad kept in contact with the borehole wall, the pads of said first and second sondes being kept aligned with a 90° azimuthal difference therebetween.

2. A logging method adapted for use in non-circular boreholes, comprising the steps of:

displacing along the wall of a borehole a first pad carrying at least a sensor to produce a log related to a property of the formations traversed by the borehole, simultaneously displacing along the wall of a borehole, at a distance from said first pad in the longitudinal direction of the borehole, a second pad carrying at least a sensor to produce a second log related to the same property, while keeping said pads oriented with a 90° azimuthal spacing therebetween.

3. A logging apparatus adapted for use in non-circular boreholes, comprising:

a first and a second sonde longitudinally displaced from each other, each sonde having:

a pad adapted for contact with the borehole wall, at least a sensor on each pad, and means for keeping the pad against the wall of the borehole, said first and second sonde producing measurements related to the same property of the formations, and means for connecting the first and the second sonde so as to keep the pads aligned with a 90° azimuthal spacing therebetween.

4. Apparatus according to claim 3, wherein said connecting means allows the sondes to offset with respect to each other.

5. Apparatus according to claim 4, wherein said connecting means comprises a knuckle joint at each end thereof.

* * * * *